US005455567A

United States Patent [19]

Simmons

[11] Patent Number: 5,455,567

[45] Date of Patent: Oct. 3, 1995

[54] CRANE ANTI TRACTOR LIFT SYSTEM

[76] Inventor: Donald E. Simmons, 2248 Colonial Ct., Byron, Calif. 94514

[21] Appl. No.: 276,611

[22] Filed: Jul. 18, 1994

[51] Int. Cl.[6] ..... G08B 21/00

[52] U.S. Cl. ..... 340/685; 212/281; 340/540; 340/531

[58] Field of Search ..... 340/685, 540, 340/531; 212/152, 149, 153

[56] References Cited

U.S. PATENT DOCUMENTS 3,805,257 4/1974 Litman et al. ..... 340/531

5,260,688 11/1993 Curry et al. ..... 340/685

*Primary Examiner*—Glen Swann

*Attorney, Agent, or Firm*—Charles E. Townsend, Jr.

[57] ABSTRACT

An automatic signaling system from a tractor-trailer being accidentally lifted with the cargo by the overhead traveling crane includes a height-change sensor for triggering a pulse generator which drives a strobe light that is seen by a discriminator mounted above on the crane. The discriminator is coupled into the hoisting circuitry only and does not affect the "lowering" circuitry; it will interrupt hoisting only if the discriminator sees strobe flashes of a particular predetermined frequency and pulse duration.

10 Claims, 3 Drawing Sheets

CRANE ANTI TRACTOR LIFT SYSTEM

This invention relates generally to crane operation and in particular to a truck mounted strobe pulse generator for signaling a discriminator coupled to the crane hoisting circuit for automatically stopping the crane during hoisting in the event of an emergency.

BRIEF SUMMARY OF THE INVENTION

The safety deactivator of the invention is usable with any type of overhead traveling crane in which the crane operator is in the overhead trolley and is unable to detect small vertical movements of his load. In an overhead crane of this type an operator could not only be lifting the intended load but also the truck or rail car, if the load were not completely disconnected.

This makes the invention valuable for use in the gantry crane loading of cargo containers aboard cargo ships where speed is often the cause of serious accidents. Cargo containers are brought to the dockside shipping center as they are filled by the shipper and the containers with attached trailers are left there while the empty rail car or the highway tractor leaves. When a ship arrives to transport the cargo containers shipping center tractors, springless vehicles that are never used on the highways, couple onto the trailers and bring them, one at a time, into one of a half dozen marked lanes under a gantry crane. When the trailer stops under the crane, it is usually met by one dockworker on each side who rushes to decouple the corners of the cargo container from the trailer while the crane operator is lowering the spreader and its corner flippers to engage the upper corners of the trailer. If it goes according to plan, the crane hoists the cargo container from the trailer and proceeds to load it on the ship while the empty trailer is moved off.

A cargo container is secured to a trailer by strong elliptical toggles at each corner of the trailer which engage and are rotated in elliptical sockets at the corners of the container. It is a very strong and reliable coupling but occasionally a dockworker is careless and, in the rush to decouple his side of the container, only partially decouples it with the result that the gantry crane lifts the cargo container together with the trailer and probably the tractor. If the crane operator notices the problem he may be able to lower the container and attached trailer and tractor. Usually, however, the trailer breaks from the container and drops with the tractor to the ground, resulting in damage to both trailer and tractor and probably to the driver.

Attempts have been made to provide some means for alerting the crane operator to impending trouble so that he can promptly lower the load. U.S. Pat. No. 5,260,688, issued Nov. 9, 1993, describes an automatic crane deactivator which receives radio deactivation signals from the tractor in the event the tractor is lifted and rotated around its front axle so that a detection wand hanging down forward of the axle contacts the ground. The radio deactivation signals are selected by the tractor driver and depend upon which one of several lanes he has driven into beneath the crane, and once the crane is deactivated, the crane operator is required to use a key operated switch to lower the load.

In the present invention, the tractor senses the partial decoupling of a container and the resulting lift of the tractor by a photoelectric sensor located in the most lift sensitive position, about two feet behind its rear axle, and is coupled to an optical strobe such as the TOMAR Fast-Flash which emits from a cab mounted Xenon lamp, pointing straight up, a continuous signal of 25 flashes per second for as long as the photoelectric sensor behind the rear axle is activated. This 25 Hz flash is detected by a discriminator circuit located above the tractor in the crane trolley. This circuit contains TOMAR Strobe Switches which produce an output only if they detect a flashing light at a particular rate and of particular duration, the same format as the pre-emption strobe. The detector switches are coupled to open a normally closed relay in the "Hoist" circuit of the crane controls, so that the crane immediately stops raising the tractor and the crane operator has full and immediate control of the "Lower" circuit.

DESCRIPTION OF THE DRAWINGS

In the drawings which illustrate the preferred embodiment of the invention.

DETAILED DESCRIPTION OF THE PREFERRED EMBODIMENT

Figure 1:
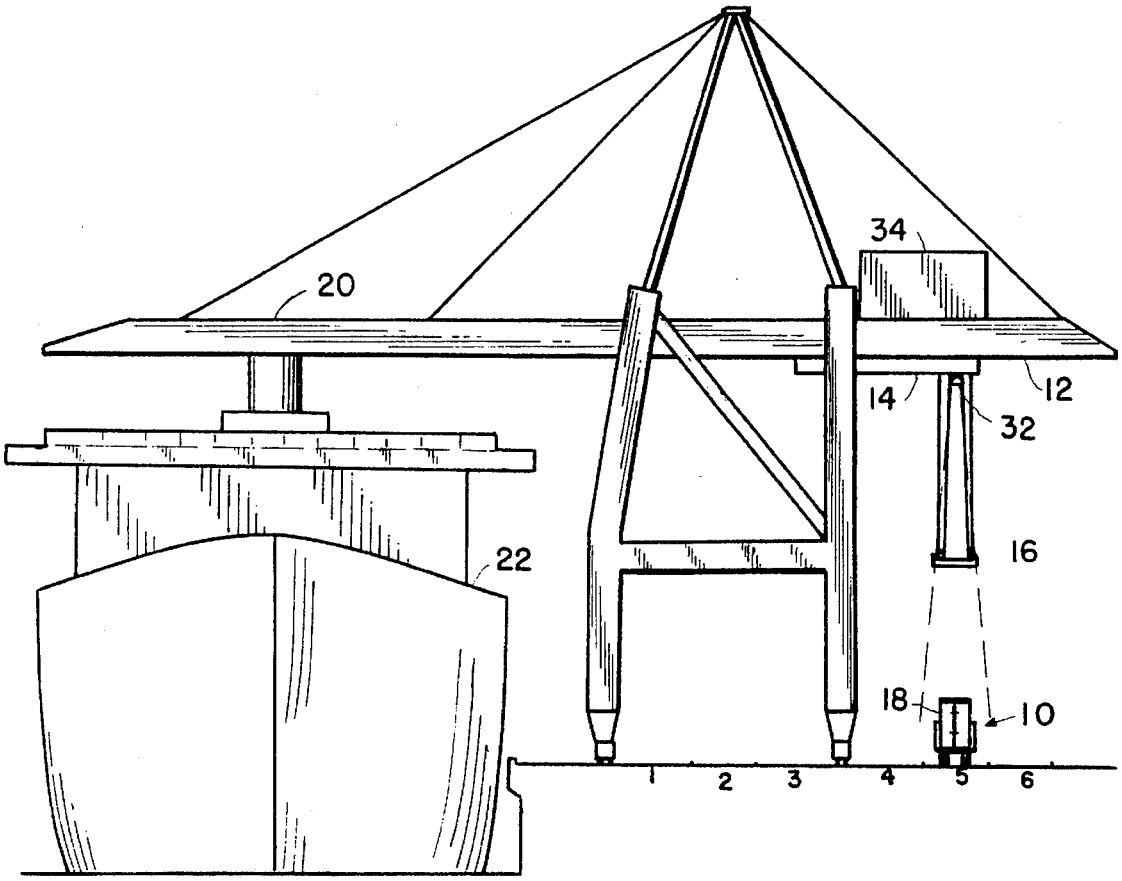
FIG. 1 is an elevational view of a gantry crane and shows a tractor-trailer which uses the invention

FIG. 1 illustrates a gantry crane for the loading and offloading of cargo containers from ships. In loading, a container on a trailer brought to the dockside shipping center by rail or by commercial truck is coupled to a dockside tractor and moved into one of several lanes beneath the crane. In FIG. 1 a tractor-trailer 10 is shown in lane No. 5 beneath the back-reach 12 of the crane. A trolley 14 is moved along the crane to a point directly above the tractor-trailer 10 and the crane operator in the trolley lowers the spreader 16 on cables for connection to the cargo container 18. The container is lifted and carried across to the front reach 20 where it is lowered into the ship 22.

Soon after moving the tractor-trailer 10 beneath the back-reach 12, a dockworker rushes to each side of the trailer to release the strong toggles that secure it to each corner of the cargo container. Occasionally, a release is not complete and the crane begins lifting the trailer and also the tractor. There have been many serious injuries when a tractor and trailer have dropped six feet or more.

This invention automatically halts further lifting after the tractor has risen only about five to ten inches off the ground.

Figure 2:
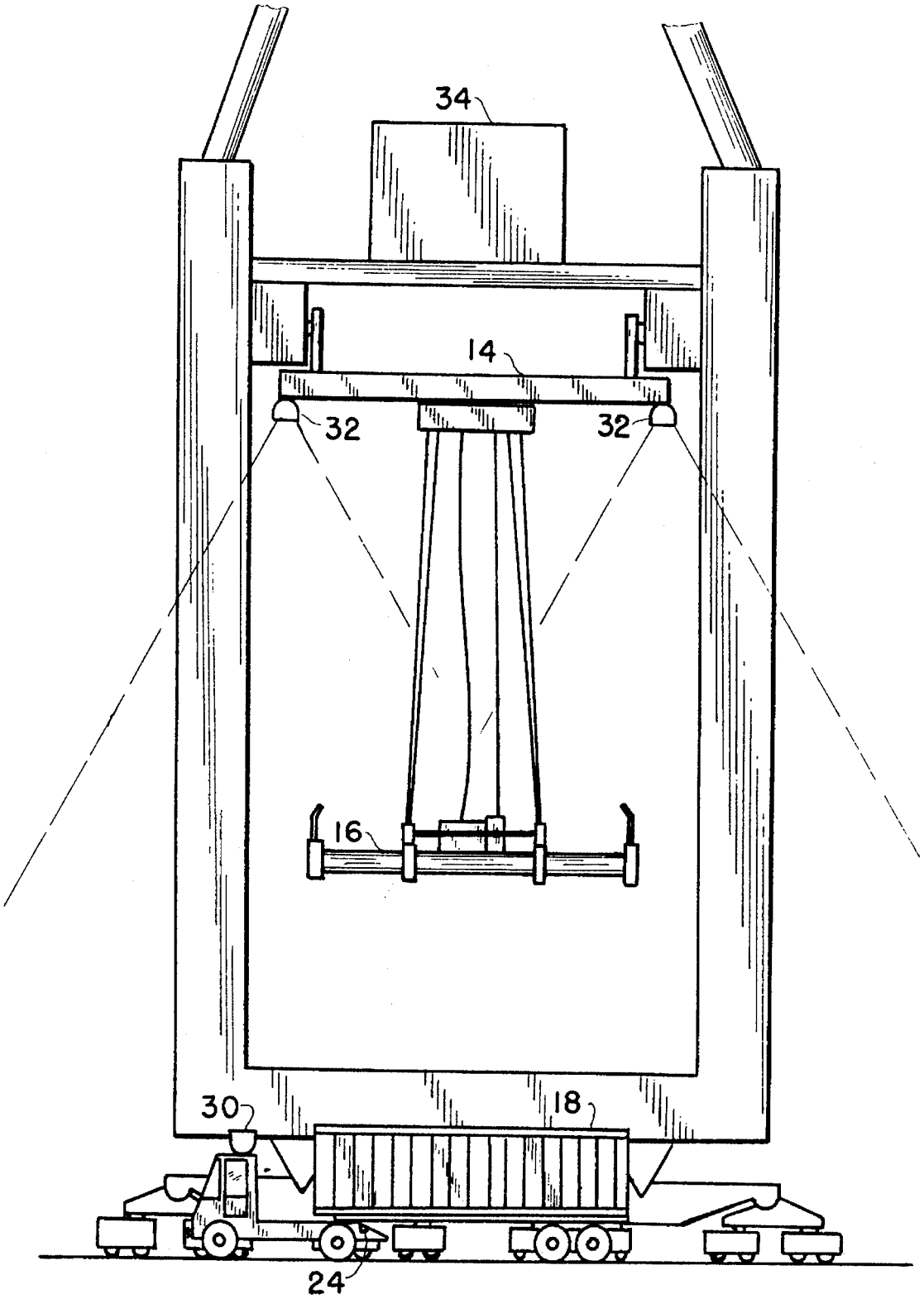
FIG. 2 is a side elevational view of FIG. 1.
Figure 4:
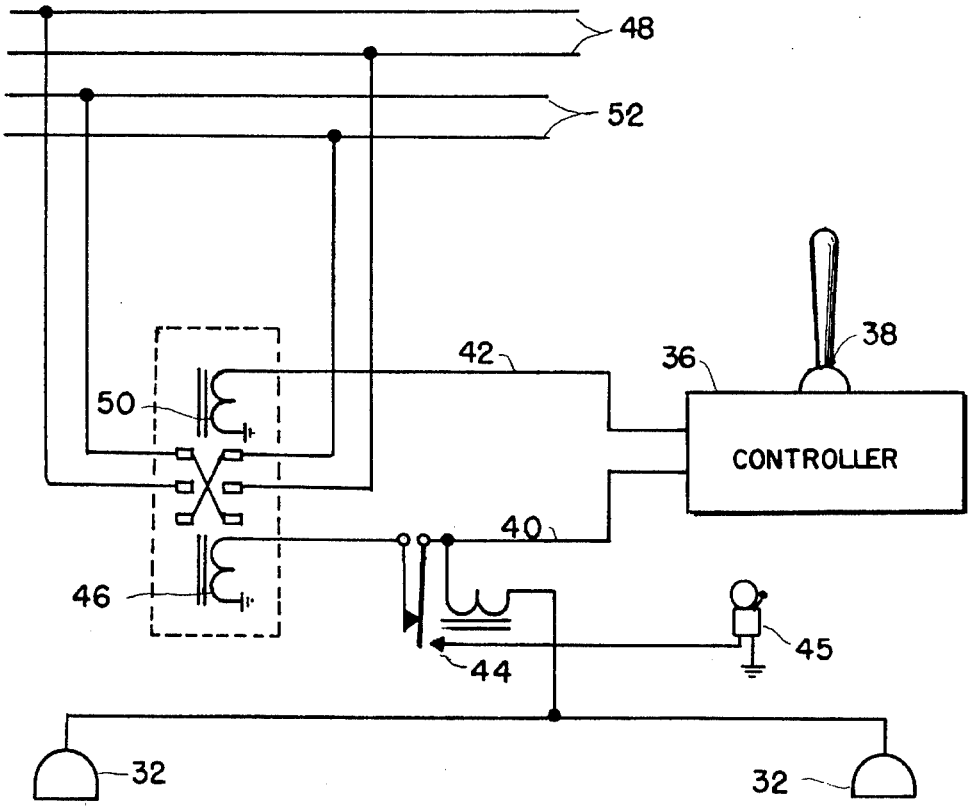
FIG. 4 is a schematic diagram of the circuitry employed in the crane.
Figure 3:
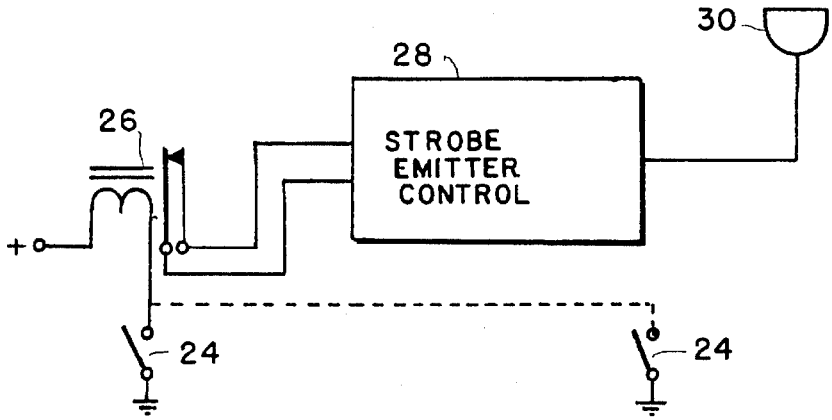
FIG. 3 is a schematic diagram of the circuitry employed in the tractor.

Referring to FIG. 2 and 3 a photoelectric sensor 24 is mounted behind the rear axle at a height of about four feet. While one photoelectric sensor 24 is adequate, two identical sensors are better, one mounted on each side for accuracy and redundancy, and at a location behind the rear axle which moves earliest and the most when a coupled trailer is lifted. Photoelectric sensor 24 is preferably a Perfect Prox manufactured by Cutler Hammer Corporation which provides a high sensing power up to a predetermined distance, followed by a sharp sensing cut-off. This type of sensor at this location on a tractor is normally always detecting the ground and senses lifting by sensing an absence of ground. It is therefore always generating an output signal and must be connected to one side of the coil of a normally-closed relay 26 the other side of which should be connected to the tractor ignition switch so that the detector circuit becomes activated by starting the tractor engine. The contacts of relay 26 are connected to the pulse generator circuit 28. If this type of lift detector 24 is located forward of the front axle or if a detector is used that produces an output upon sensing an approach to the ground, the relay 26 must be changed to a normally-open type.

The pulse generator circuit 28 drives a single Xenon flash tube located within a pulse generator head 30 which is located on top of the tractor cab and aimed up toward the zenith. The pulse generator head 30 and the pulse generator circuit 28 are manufactured by Tomar Electronics Inc. of Gilbert, Arizona which designates them a pre-emption emitter system because they are normally sold only to state and local government authorized dealers for use by police, fire and emergency vehicles for traffic pre-emption and to open gates equipped with a discriminator such as a Tomar Strobe Switch which senses the frequency and duration of the light pulses from an emitter head located on an emergency vehicle. The frequency of the standard pre-emptive emitter system is 14 Hz; however, in order to speed the signal acquisition time and therefore make the system more sensitive for this application, the pulse generator circuits 28 and emitter heads 30 have been changed to operate at the faster rate of 25 Hz.

Preferably two pulse discriminators 32 are adjusted to produce an output signal only upon sensing light pulses that match in frequency and duration those emitted by the pulse generator head 30 on the tractors are mounted on each side of the crane trolley 14 and are pointed down toward the nadir so that one discriminator will always see a tractor that is below. They will reject all unwanted signals, such as flashing headlights, and are not susceptible to radio interference. The pulse discriminators 32 have the very fast acquisition time of less than 0.2 seconds, they have a detection range of at least 600 feet and have a field of view that covers 60 degrees along the lanes below (as shown by the dashed lines in FIG. 2) and only 10 degrees athwart the lane, as shown by the dashed lines in FIG. 1.

Most heavy duty cranes such as a gantry crane use direct current for driving the series wound hoisting motors because of the ease of speed and direction control. Usually, A.C. power drives an A.C. motor connected to a D.C. generator, both being located in a machinery house 34 located near the trolley 14. The D.C. is fed through appropriate controls in the operator's cage on the trolley 14 to the hoisting and propulsion motors. One of the controls for the operator is a direction and speed controller 36 which includes a toggle 38 for controlling the hoisting motor. The operator pulls the toggle toward him to hoist the spreader 16 and pushes it from him to lower it, the further the toggle 40 is moved from its neutral center, the faster the hoisting or lowering.

The two pulse discriminators 32 on the crane trolley 14 are connected only into the hoist circuit 40 of the controller 36 so that when either one of them become activated by the correct strobe signal from the pulse generator heads 30 on a truck below, a hoisting operation will be immediately interrupted but will not affect the operator's control over the lowering circuit 42 which can be immediately activated to lower an accidentally lifted tractor.

The two pulse discriminators 32 are connected to one side of the normally-closed relay 44 the opposite terminal of which is connected to the control conductor in the hoist circuit 40. Relay 44 should have single pole-double throw contacts so that upon excitation of the relay coil, the contacts will break the hoisting circuit while making a circuit to an alarm 45 that will instantly alert the crane operator to a problem. The normally-closed contacts of relay 44 connect the hoist circuit 40 to the hoist excitation coil 46 of a heavy duty magnetic contactor which is connected to the conductors 48 from the D.C. generator in the machinery house 34. Excitation coil 46 draws downward the center contacts to engage the lower contacts in the magnetic contactor thus applying D.C. power of one polarity to the conductors 52 to the hoisting motors. Similarly, actuating the toggle 38 in the opposite direction will stop the hoisting signal to the coil 46 and apply a signal to the lowering excitation coil 50 which will draw the center pair of contacts up to engage the top contacts, thus applying D.C. power of a second, or reverse polarity to the conductors 52.

It should be noted that the invention described is not affected by radio interference that is often present in a dock area. It is completely automatic in that it is always "on" while a tractor engine is running and there are no decisions to be made or switches to be selected by a busy tractor driver, and upon receiving an alarm of a problem, a crane operator need only toggle the control to lower the spreader since the discriminator circuitry only breaks into the hoist circuit to immediately stop hoisting after a sensor on a tractor has been lifted a maximum of about ten inches by a faulty disconnection of the container from the trailer.

I claim:

1. A crane anti tractor lift system for interrupting the hoisting power of a crane in response to signals indicative of the accidental lifting of a vehicle beneath said crane, said deactivation system comprising:

at least one sensor unit mounted on the vehicle for producing a first signal upon sensing an elevation change of said sensor;

a pulse generator in said vehicle and responsive to said first signal for generating a pulse signal of predetermined pulse rate and duration;

a pulse generator head on said vehicle and responsive to said pulse signal, said pulse generator head directed toward the zenith and producing strobe light flashes of said predetermined pulse rate and duration;

at least one pulse discriminator mounted upon the crane and directed down toward the nadir, said pulse discriminator producing a second signal upon sensing said strobe light flashes of said predetermined pulse rate and duration;

means in the hoisting circuitry of said crane and responsive to said second signal for interrupting said hoisting circuitry.

2. The crane anti tractor lift system claimed in claim 1 wherein said crane is a traveling crane having a trolley and wherein said pulse discriminator is mounted on said trolley.

3. The crane anti tractor lift system claimed in claim 2 wherein the crane trolley has two pulse discriminators, one mounted on each side of said trolley.

4. The crane anti tractor lift system claimed in claim 3 wherein said crane is a gantry crane and wherein said vehicle is a tractor that has drawn a trailer in a lane beneath said gantry crane.

5. The crane anti tractor lift system claimed in claim 4 wherein said pulse discriminators on each side of said crane trolley have a field of view of approximately 60 degrees along the lane of said tractor and trailer and approximately ten degrees across said lane.

6. The crane anti tractor lift system claimed in claim 2 wherein said crane has hoisting and lowering circuitry and wherein said said pulse discriminator has no control of said lowering circuitry.

7. The crane anti tractor lift system claimed in claim 2 wherein said pulse discriminator on said crane operate a double throw relay having normally closed contacts in series with the hoisting control circuitry of said crane and normally open contacts that connect an alarm to an alarm power source.

8. The crane anti tractor lift system claimed in claim 1 wherein said sensor unit is a photo-electric sensor.

9. The crane anti tractor lift system claimed in claim 8 wherein said photoelectric sensor is mounted behind the rear axle of said vehicle, and wherein said first signal produced is the absence of a generated signal upon an increase in elevation of said sensor.

10. The crane anti tractor lift system claimed in claim 9 wherein said sensor unit is continually operational while the engine of said vehicle is running.

* * * * *